US005466176A

United States Patent [19]

Cornell et al.

[11] Patent Number: 5,466,176

[45] Date of Patent: Nov. 14, 1995

[54] CABLE CLAMP WITH MOISTURE RESISTANT SHIELD AND METHOD FOR USING SAME

[75] Inventors: Paul A. Cornell, Waterford; Roy K. Warner, Cork, both of Ireland

[73] Assignee: Pan Electric Corporation, Carson City, Nev.

[21] Appl. No.: 195,271

[22] Filed: Feb. 14, 1994

[30] Foreign Application Priority Data

Mar. 17, 1993 [GB] United Kingdom ..... 9305487

[51] Int. Cl.[6] ..... H01R 4/02

[52] U.S. Cl. ..... 439/789; 439/932

[58] Field of Search ..... 439/838, 863, 439/789, 828, 796, 798, 797, 736, 751, 750, 932

[56] References Cited

U.S. PATENT DOCUMENTS

| | | | |
|---|---|---|---|
| 2,863,132 | 12/1958 | Sowa | 439/932 X |
| 3,963,303 | 6/1976 | Hays | 439/932 X |
| 4,357,068 | 11/1982 | Cornell et al. . | |
| 4,479,694 | 10/1984 | Cornell et al. . | |
| 4,501,927 | 2/1985 | Sievert | 439/750 X |
| 4,548,462 | 10/1985 | Cornell . | |
| 4,898,551 | 2/1990 | Cornell . | |
| 5,137,478 | 8/1992 | Graf et al. | 439/932 X |

*Primary Examiner*—David L. Pirlot
*Assistant Examiner*—Daniel Wittels

[57] ABSTRACT

A cable clamp includes first and second jaws secured together by a fastener to clamp a cable therebetween. A shield member is mounted to the longer of the jaws, adjacent to the shorter of the jaws, and a moisture resistant cover is sealed to the shield member, around the shorter jaw and to a clamped cable. The fastener includes a boss with a threaded opening on one of the jaws, which boss is received by an opening in the other of the jaws. A bolt engages the threaded opening to clamp the jaws on the cable.

15 Claims, 4 Drawing Sheets

CABLE CLAMP WITH MOISTURE RESISTANT SHIELD AND METHOD FOR USING SAME

BACKGROUND OF THE INVENTION

The present invention relates to an improved cable clamp, which can be used to terminate a cable, for example to a bus bar. It is known to provide cable clamps comprising a male jaw having a tail and an integral part-cylindrical head, and a female jaw having a tail and an integral yoke which defines a part-cylindrical socket, the head of the male jaw being received in the socket to permit relative pivotal movement between the jaws, a cable receiving opening extending diametrically through the head and a cable receiving opening extending radially through the yoke, the said openings being aligned in an open pivotal position of the jaws to permit insertion of the cable therethrough and substantially misaligned in a closed pivotal position of the jaws to clamp the cable, the tails being clamped together to hold the jaws in the closed position.

The cable clamps of this form shown in Cornell U.S. Pat. Nos. 4,357,068, 4,479,694, 4,548,462 and 4,898,551 have been found to provide excellent operational characteristics. They can be easily installed without special tools; they provide high cable pull-out resistance and low electric resistance; and it may be arranged that the inner part of the clamp can be assembled into the outer part of the clamp in two separate orientations, each adapted to terminate a particular diameter cable.

For these reasons, clamps of this type are increasingly popular. One high volume application for such clamps is at the point where power is taken from power transmission lines. Such connections are usually made at the top of transmission poles with the clamp in a vertical orientation and the cable leaving the clamp vertically downwards. This orientation presents problems, especially in outdoor situations, of moisture entering the upwardly pointing cable and penetrating inside the insulation. Such moisture penetration can cause electrical problems with the cables.

One object of the present invention therefore is to provide a cable clamp in which the cable may be protected from moisture penetration as described above.

SUMMARY OF THE INVENTION

Accordingly, the present invention provides a cable clamp having a first end, a second end, and a longitudinal axis extending therebetween, comprising a clamping structure adjacent said first end adapted to clamp the end of a cable, an attachment structure adjacent said second end adapted to permit attachment of said clamp to an external surface, and a shield member between said clamping structure and said attachment structure, said shield member having a circumference defining a sealing surface positioned radially outwardly with respect to the attachment structure whereby in use the clamping structure may be provided with a cover sealed to the sealing surface of said shield member to inhibit moisture penetration into a clamped cable. The cover should ideally also extend over the end of the remaining insulation on the clamped cable. There is thus provided a generally tubular sealed unit at the end of the cable.

According to the method of this invention, a cable clamp as described in the preceding paragraph is used to clamp a cable, and then a moisture resistant cover is applied to the cable and the cable clamp so that the cover seals to the cable on one side of the clamping structure and to the shield number on the other side of the clamping structure. In this way, the first jaw is positioned within the cover, and the cover resists moisture penetration into the clamped cable.

In the clamp of the type described above in the preceding section, a fastener is provided to clamp the tails together to clamp the cable. This is generally a nut and bolt assembly passing through holes in the tails. Therefore the profile of the clamps is increased by a bolt head on one side of the clamp and a nut on the other. In a further aspect of the present invention the fastener comprises a threaded hole in one of the tails, an unthreaded hole in the other tail which aligns with the threaded hole, and a bolt. The clamping of the tails is achieved by passing the bolt through the unthreaded hole and engaging it in the threaded hole. This arrangement provides the advantage that the nut is eliminated, reducing the end-on profile of the clamp.

In a particularly preferred form of the fastener the threaded hole extends through a protruding boss, over which the unthreaded hole fits. As described in detail below, this arrangement provides the additional advantage that a shorter bolt may be used to clamp the tails together, which ensures that the end of the bolt does not protrude through the clamped tails.

Although the invention is described in terms of the vertical orientation mentioned above, it will be appreciated that the generally tubular sealed unit provides protection from moisture in other orientations, and that these are included in the scope of this invention.

The separation of the operations of clamping the clamp to the end of a cable and mounting it to a bus bar or the like provides a further advantage of facilitating the installation of the clamp because fewer separate parts have to be brought into the correct alignment at each stage of assembly.

BRIEF DESCRIPTION OF THE DRAWINGS

A preferred form of a cable clamp in accordance with the invention will now be described by way of example, with reference to the accompanying drawings, in which.

DETAILED DESCRIPTION OF THE PRESENTLY PREFERRED EMBODIMENTS

Figure 1:
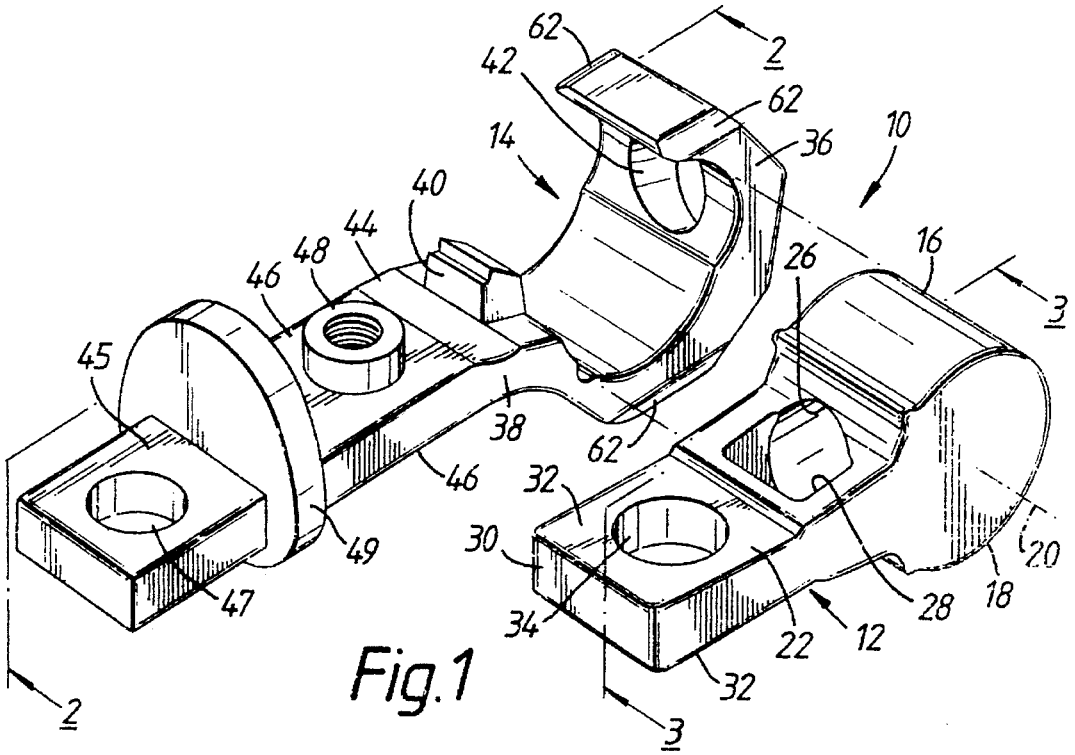
FIG. 1 is a perspective view of the presently preferred embodiment of the cable clamp of this invention.

FIG. 1 shows a perspective view of a cable clamp 10 which incorporates a presently preferred embodiment of this invention. As shown in FIG. 1, the cable clamp 10 includes a male jaw or clamping member 12 and a female jaw or clamping member 14. The male jaw 12 is shown in greater detail in FIGS. 3 and 3*a*, and it includes a cylindrical head 16 which defines a cylindrical surface 18 centered on a cylinder axis 20 (FIG. 1). A first tail 22 extends radially away from the head 16, and the male jaw 12 is symmetrical about a plane of symmetry 24 (FIG. 3) which contains the cylinder axis 20.

Figure 3:
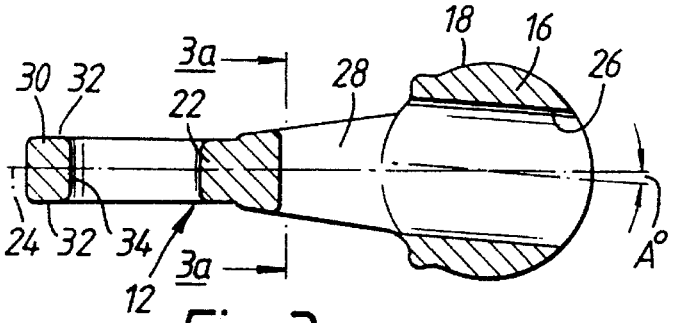
FIG. 3 is a sectional view taken along line 3—3 of FIG. 1.
Figure 3A:
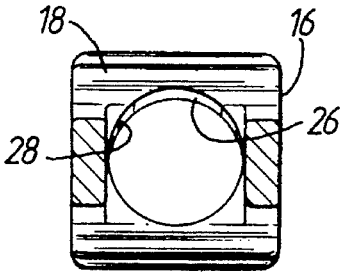
FIG. 3*a* is a sectional view taken along line 3*a*—3*a* of FIG. 3.

The male jaw 12 includes a first cable receiving opening 26 that, as shown in FIG. 3, is oriented at a skew angle A with respect to the first tail 22 and the plane of symmetry 24. The cable receiving opening 26 is adapted to receive the terminal portion of a cable, and the opening 26 opens out at both sides of the first tail 22 at a window 28 which passes completely through the tail 22.

The tail 22 defines a free end 30 and a pair of spaced, parallel, opposed first surfaces 32 adjacent the free end 30. Both of these first surfaces 32 are parallel to the plane of symmetry 24. A fastener receiving opening 34 extends completely through the first tail 22 and receives a mounting fastener as described below.

Figure 2:
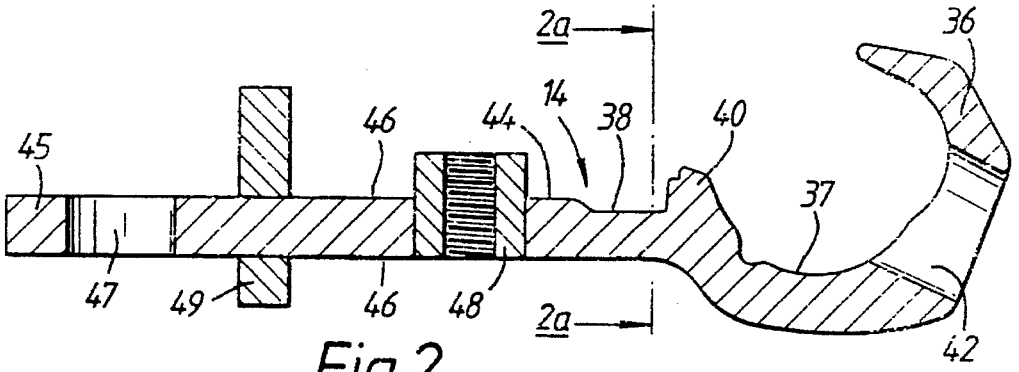
FIG. 2 is a sectional view taken along line 2—2 of FIG. 1.
Figure 2A:
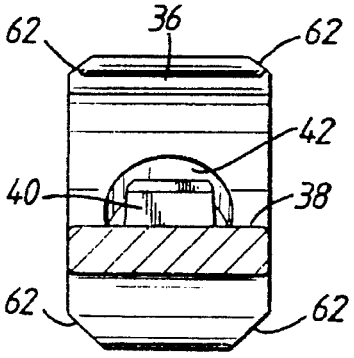
FIG. 2*a* is a sectional view taken along line 2*a*—2*a* of FIG. 2.

FIGS. 1, 2 and 2*a* provide a detailed illustration of the female jaw or clamping member 14, which includes a head receiving portion or yoke 36 which is generally C-shaped and defines a part-cylindrical socket 37 sized to receive the cylindrical head 16 for rotation about the cylinder axis 20. The yoke 36 is integrally connected with a second tail 38 that includes a projection 40 positioned to extend into the window 28 when the first and second tails 22, 38 are clamped together.

A second cable receiving opening 42 extends through the yoke 36 and is positioned to align with the opening 26 when the jaws are in an open position, in which the first and second tails 22, 38 are separated from one another. The second tail 38 defines an intermediate portion 44, an end portion 45 and two opposed parallel second surfaces 46. A threaded boss or key 48 is fixed in an opening 51 passing through the intermediate portion 44 of the second tail 38 and is aligned with the opening 34 when the first and second tails 22, 38 are clamped together, such that the opening 34 fits over the upstanding part of the boss 48.

Figure 4:
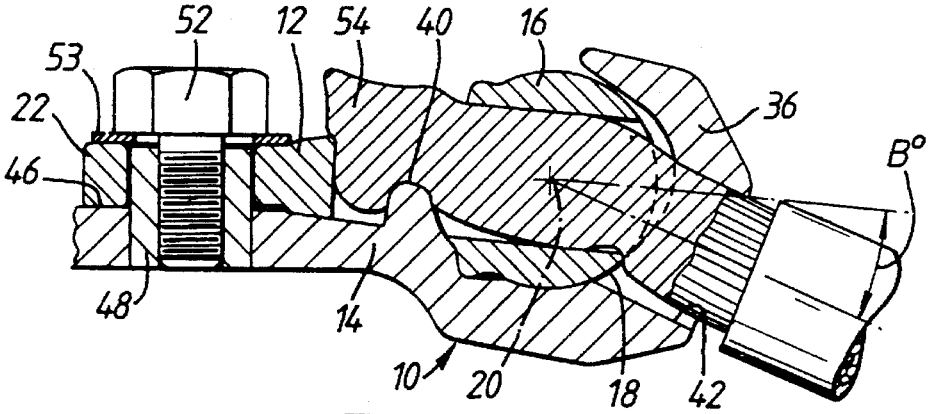
FIG. 4 is a sectional view of part of the cable clamp of FIG. 1, with the clamping device configured to clamp a relatively larger cable.
Figure 5:
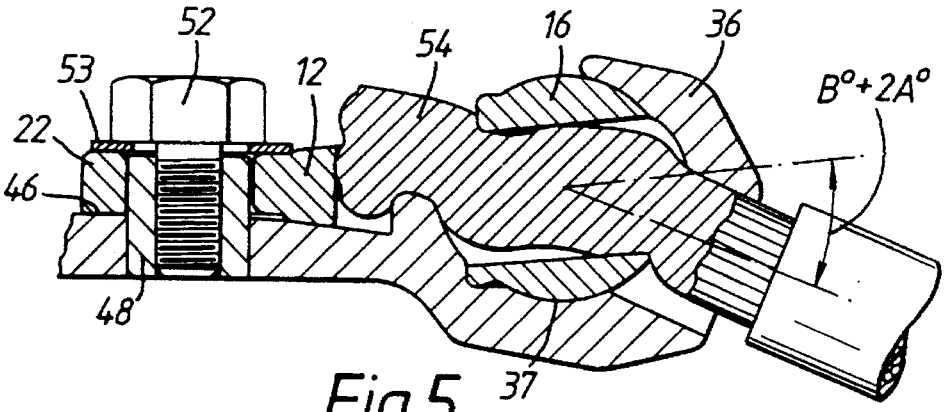
FIG. 5 is a view corresponding to that of FIG. 4 with the clamping device configured to clamp a relatively smaller cable.

FIGS. 4 and 5 show the manner in which the cable clamp 10 can be arranged to clamp a cable by a fastener 52. The fastener 52 clamps the first and second tails 22, 38 together.

In use, the fastener 52 is initially removed and the male jaw 12 is rotated to an open position (not shown) in which the first and second tails 22, 38 are spaced one from another. Then the terminal portion 54 of a cable is inserted through the cable receiving openings 26, 42 until it abuts against the extreme end of the window 28. Then the male jaw 12 is rotated toward the closed position shown in FIGS. 4 and 5, and the fastener 52 is used to clamp the first and second tails 22, 38 together. This causes the projection 40 to enter the window 28 and the cable to be clamped at four clamping points as shown by the arrows in FIG. 4. In this way the male jaw 12 and adjacent portions of the female jaw 14 cooperate to form a cable clamping structure.

As shown in FIGS. 4 and 5, the jaws 12, 14 can be assembled in two different orientations to clamp cables of two different diameters. In FIG. 4 the male jaw 12 is in a first orientation in which the angle B separates the open and closed positions. In FIG. 5 the male jaw 12 has been rotated by 180° about an axis of symmetry that is contained in the plane of symmetry 24 and is perpendicular to the cylinder axis 20. Because of the skew angle A shown in FIG. 3, in this alternate position the angular separation between the open and closed positions of the male jaw 12 is B+2A, and thus the cable clamp 12 when assembled as shown in FIG. 5 operates to clamp a smaller cable. In this regard, the cable clamp 10 functions in similar manner to the cable clamp described in detail in the above-identified Cornell patents.

The fastener 52 is in the form of a bolt 52 which passes through opening 34 in the tail 22 of the male jaw to engage with the threaded hole of the boss 48. As illustrated, a washer 53 may be included if necessary or desirable.

It is desirable that bolt 52 should not protrude through the boss 48 in order to minimize the end-on profile of the assembled clamp. During installation the tails of the clamp must be closed, by some external force, sufficiently that a bolt positioned through opening 34 will reach and engage the thread of the opening through the other tail. After such engagement the clamp is closed further by tightening of the bolt. Because of the upstanding boss, the clamp does not have to be closed as much as it would be in the absence of the upstanding boss 48 before the bolt engages the thread, for a given length of bolt. Alternatively, for a given possible amount of closure by the external force, a shorter bolt can be used to close the clamp fully. In particular, in many applications, a bolt can be used which does not protrude through the clamped tails, even when the clamp is fully closed.

As is apparent from the drawings, the preferred arrangement is to provide a boss 48 which protrudes above the surface of tail 38 by an amount approximately equal to, but slightly less than, the thickness of the tail 22, and to use a bolt having a length approximately equal to the combined thickness of the two tails.

The clamp may be attached to a support element such as a bus bar either before or after the cable is clamped as described above. This attachment is preferably by way of an opening 47 in the end portion 45 of the second tail 38. The opening 47 is aligned with a corresponding opening in the support element (not shown), and a nut and bolt assembly (not shown) is passed through the openings to secure the clamp. In this way the end portion 45 of the second tail 38 including the opening 47 forms an attachment structure. Alternatively, either one of the openings may be threaded and attachment of the clamp can be by way of a single bolt in a manner similar to that described above for the clamping of the tails.

The shield member of the present invention is embodied in the clamp 10 by a planar member 49. As is apparent from the drawings, if the clamp 10 is used in the above discussed vertical orientation with the end portion 45 uppermost, the shield member 49 is positioned above the clamping arrangement and the clamped cable. The shield member 49 has a rounded profile and has a profile which generally coincides with the end-on profile of the rest of the clamp. After the cable has been clamped as described in detail above and bolt 52 is in position, the majority of the clamp, up to the shield member 49 can be enclosed in a waterproof cover. Thus the clamping arrangement including the two heads of the jaw members are covered, together with the fastener 52 and the end of the clamped cable from which the insulation is removed. The cover is sealed around the circumference of the shield member 49.

Figure 6:
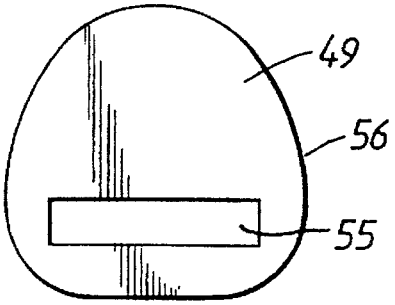
FIG. 6 is an elevational view of the shield member of the cable clamp of FIG. 1.

FIG. 6 illustrates the shield member 49 according to this preferred embodiment. Shield member 49 is planar and has a rounded circumference 56 which forms a sealing surface and defines a profile which generally coincides with the end-on profile of the rest of the clamp. Shield member 49 is also provided with a slot 55, which enables the shield member 49 to be slid over the end portion 45 of the tail 38 to the position shown in FIGS. 1 and 2. The edges of the slot 55 are preferably sealed to the tail 44 to prevent moisture penetration through the slot 55. This seal is preferably formed by the use of a waterproof adhesive, such as an anaerobic engineering adhesive, which is impervious to moisture and of high strength. The adhesive manufactured by the LocTite Company and identified as product number 648 has been found suitable. If desired, the tail 44 may be provided with a protrusion or rib (not shown) against which the shield member 49 abuts when in position in order to facilitate positioning of the shield member to avoid interference with the operation of the clamp.

The shield member 49 is preferably sufficiently rigid to retain its shape when the waterproof cover is applied to the clamp. The coefficient of thermal expansion of the shield member 49 is preferably matched to that of the tail 44 to reduce stress on the seal between the tail 44 and the shield member 49. This can be accomplished by forming the shield member 49 of the same conductive alloy as the tail 44. By way of example, the shield member 49 may have a thickness of 10 mm and a circumference substantially equal to the maximum circumference of the clamping arrangement. The shield member 49 is preferably convex and smoothly rounded to enhance sealing with the waterproof cover. The illustrated embodiment retains its shape under the forces applied by the cover.

The end-on profile of the shield need not be exactly the same as that of the clamping arrangement. It is preferred that the profile of the shield should be rounded, which facilitates the sealing of the cover. Also the overall size of the shield may be different from that of the end-on profile of the clamping means, in particular it may be smaller, and still allow a cover to be applied forming a generally tubular unit.

In order to facilitate the use of the clamp in as many situations as possible it is preferably made as compact as possible. In particular the area of the end-on profile and the shield should be minimized as this affects the size of the final generally tubular sealed unit. In some applications there are standards for the size of the clamps which must also be met. Accordingly this invention is preferably incorporated into clamps having a small head profile. Also the profile can be reduced by the use of the fastener as discussed above.

Figure 7:
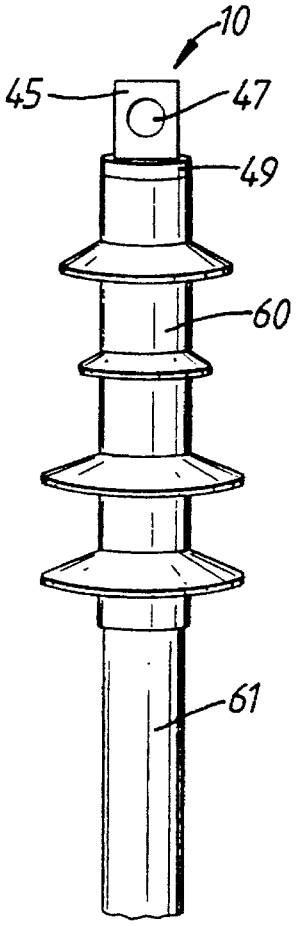
FIG. 7 is a sketch showing the cable clamp of FIG. 1 installed in a cover.

FIG. 7 is a sketch illustrating the installation of the clamp 10 in a cover 60. As can be seen from this figure, the only parts of the clamp 10 visible once the cover 60 is installed are the end portion 45 of the female jaw with the opening 47 to allow mounting of the clamp 10. As described above, the cover 60 covers all the other parts of the clamp 10 and also extends over a length of the cable 61, thereby providing protection from moisture ingress for the clamped end of the cable.

The cover illustrated is a typical type of cover which may be used with this invention, having known electrical stress relieving discs around it. The clamp of the present invention is particularly constructed to be usable with standard covers for this type of installation. For instance the invention may be used with heat shrink tubes, cold shrink tubes or with self-amalgamating tape wound around the clamp.

Figure 8:
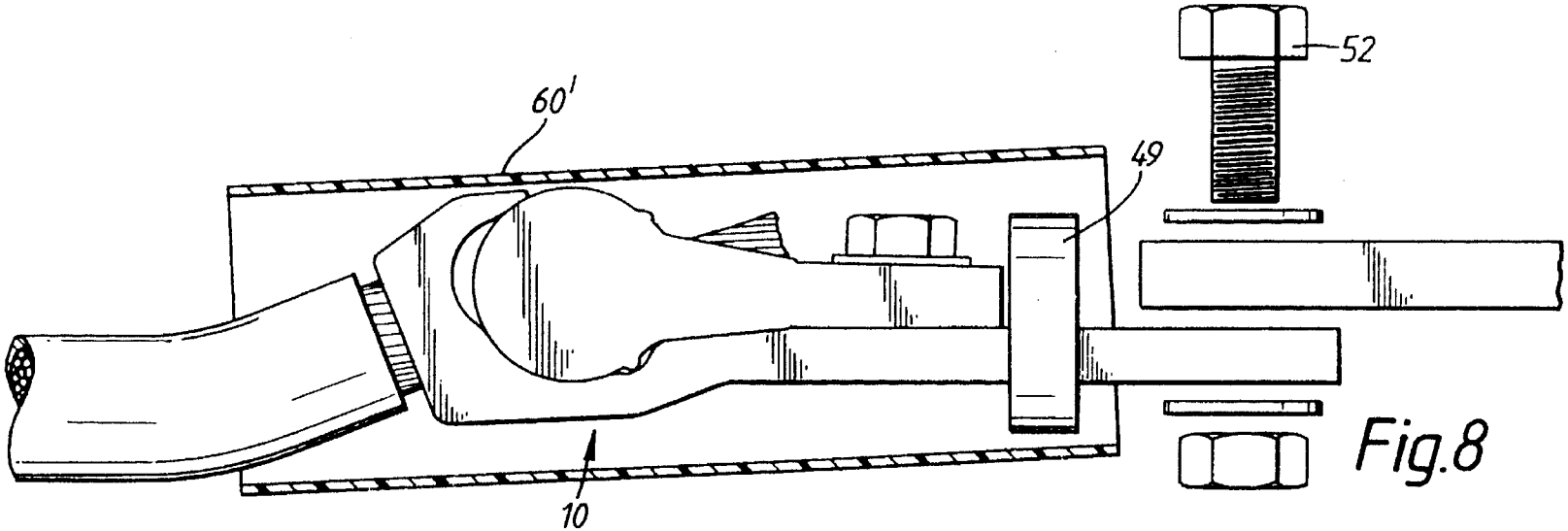
FIG. 8 is an exploded sectional view showing the cable clamp of FIG. 1 assembled with an unrecovered length of heat shrink tube.
Figure 9:
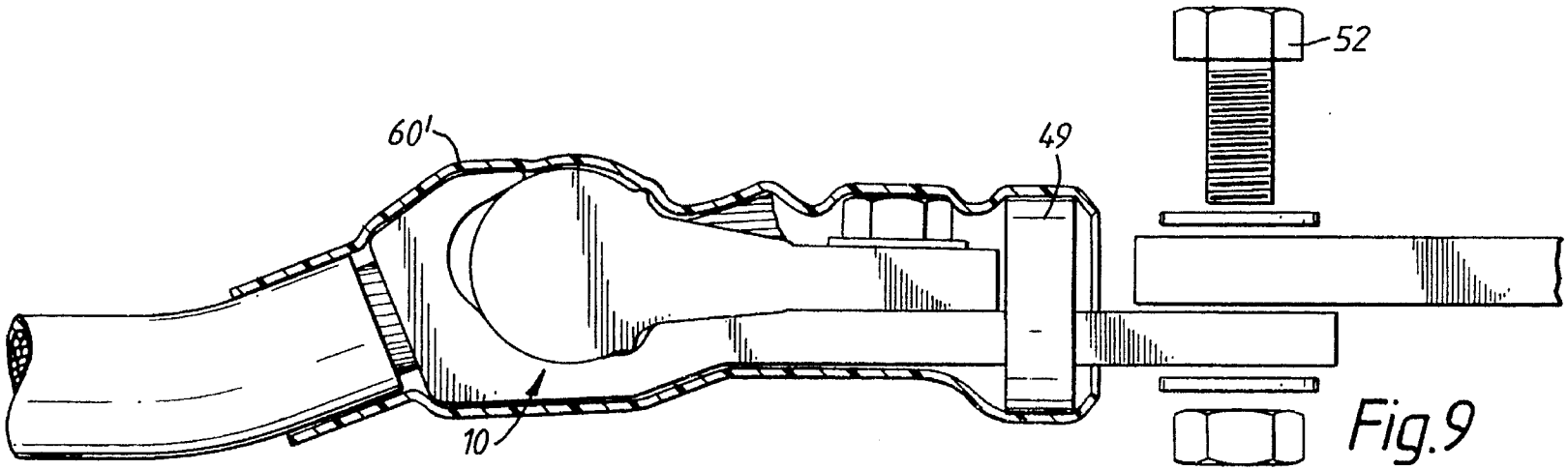
FIG. 9 is an exploded sectional view showing the cable clamp of FIG. 1 assembled with a fully recovered length of heat shrink tube.

FIGS. 8 and 9 show two steps in applying a second waterproof cover 60' to the clamp 10. First, the clamp 10 is applied to the cable, using the bolt 52 to develop the required clamping force. Then the cover 60' (an unrecovered length of heat shrink tube) is positioned as shown in FIG. 8 around a portion of the cable, the clamping arrangement, and the shield member 49. The cover 60' is then shrunk in place in the conventional manner, as for example by applying heat or removing an expanding sleeve. This causes the cover 60' to conform to the clamp 10 as shown in FIG. 9, and to form a moisture resistant seal against the sealing surface at the perimeter of the shield member 49 and at the cable adjacent to the clamp 10. As is conventional, the cover 60' may include on its inner surface a layer of sealing material to enhance formation of a moisture resistant seal with the shield member 49 and the cable.

In order to facilitate the use of the invention with standard tubular type covers, the corners of the clamp, in particular the female jaw member, may be rounded. This is illustrated in the preferred embodiment as indicated at numeral 62 of FIG. 2*a*.

Simply by way of example, the jaws 12, 14 are preferably machined from extruded bar stock. The bar stock is preferably an aluminum alloy having an electrical conductivity of not less than 46% of the International Annealed Copper Standard and a tensile strength of approximately 300 MPa. The cable receiving openings should preferably be sized approximately 110% of the largest cable to be clamped.

In the case where the jaws are produced from extruded bar stock, the opening 47 is separately machined into jaw 14, as is the threaded opening. As is apparent from FIG. 2, in the preferred embodiment the threaded opening is provided by first machining a second opening 51 of approximately the same size as the opening 47 and inserting and fixing the boss 48 into the second opening. The boss 48 may be of a different material, metal or alloy to that used for the jaws. The threaded opening may also be provided by machining a boss and a threaded hole directly in the material of jaw 14, as is presently preferred.

It should be understood that the invention is not limited to the described embodiment. In particular the means for mounting the clamp to another surface and the shield member may be provided on the tail of the male jaw member. Also the threaded hole and/or boss for the first fastening means may be provided in the tail of the male jaw member.

Of course, it should also be understood that this invention is not limited to use in cable clamps of the types shown in the above-identified Cornell patents, and that it can be adapted to other types of cable clamping devices.

It will be apparent that in cable clamps described above, the act of clamping the cable clamp to the end of the cable is separated from the act of attaching the clamp to the required bus bar or the like. As described above, the opening 47 allows the clamp 10 to be bolted to a bus bar after the waterproof cover has been applied, and the opening 47 is physically separated from the fastener 52, which is inside the waterproof covering.

This feature provides further advantages in simplifying the installation of the cable clamp, especially in relatively inaccessible situations such as the top of a utility pole. The clamp may be attached to the end of the cable and the waterproof cover applied to the clamp, for instance by shrink wrapping, at any time and position and before the attachment to the bus bar or the like is made. The attachment to the bus bar is therefore facilitated because the installer effectively has a cable with a bolt hole at the end which simply requires attaching as required. Thus the alignment of the cable with the clamp and the application of the cover can be performed away from the actual place of installation, and need not be performed in relatively inaccessible places.

The boss 48 allows the clamp to be closed in many applications with a short bolt 52. In this way the need for special installation tools, such as hydraulic equipment or ratchet wrenches for determining bolt tightness, is reduced or eliminated. These clamps can therefore be easily installed on cables in difficult settings, such as on utility poles.

We claim:

1. A cable clamp comprising first and second jaws configured to clamp a cable in a clamping region, said first jaw having a length less than that of the second jaw, said second jaw comprising an attachment structure adapted to permit attachment of said cable clamp to an external surface, said cable clamp further comprising a shield member secured in a substantially water-tight manner to the second jaw to protrude outwardly therefrom, said shield member positioned between the attachment structure and the clamping region and comprising a sealing surface, said shield member having a circumference defining a sealing surface positioned radially outwardly with respect to the attachment structure, whereby in use the clamping structure may be provided with a cover sealed to said shield member to inhibit moisture penetration into a clamped cable.

2. A cable clamp according to claim 1 in which the shield member is generally planar and is positioned such that a longitudinal axis of the clamp is substantially normal to the plane of the shield member.

3. A cable clamp according to claim 1 or 2 in which the end-on profile of the shield member is rounded.

4. A cable clamp according to claim 1 or 2 wherein one of the jaws comprises a male jaw having a tail and an integral part-cylindrical head, and the other of the jaws comprises a female jaw having a tail and an integral yoke which defines a part-cylindrical socket, the head of the male jaw being received in the socket to permit relative pivotal movement between the jaws, a cable receiving opening extending diametrically through the head and a cable receiving opening extending radially through the yoke, said cable receiving openings being aligned in an open pivotal position of the jaws to permit insertion of the cable therethrough and substantially misaligned in a closed pivotal position of the jaws to clamp the cable, said tails being clamped together to hold the jaws in the closed position, the clamping arrangement further comprising a fastener arranged to clamp said tails together.

5. A cable clamp according to claim 4, in which one of said tails is provided with a first, threaded opening and the other of said tails is provided with a second, unthreaded opening, the first and second openings being aligned when said jaws are in the closed position, and said fastener comprising a bolt which passes through said first opening to threadedly engage said second opening.

6. A cable clamp according to claim 5, in which said second, threaded opening is provided in a protruding boss, which protrudes into said first opening when said jaws are in the closed position.

7. A cable clamp according to claim 4 in which said attachment structure comprises an opening in one of said tails arranged to receive a bolt.

8. A cable clamp according to claim 1 further comprising a cover adapted to inhibit moisture penetration enclosing the clamping structure and sealed to the shield member.

9. A cable clamp according to claim 8 wherein the attachment structure extends beyond the cover.

10. A water-resistant cable clamp/cable assembly comprising:

a cable;

a cable clamp comprising first and second jaws configured to clamp the cable, said first jaw having a length less than that of the second jaw;

a fastener clamping the first and second jaws on the cable;

an attachment structure included in the second jaw;

a shield member secured in a substantially water-tight manner to the second jaw to protrude outwardly therefrom, said shield member positioned between the attachment structure and the cable and comprising a sealing surface; and a tubular water resistant cover sealed at one end to the sealing surface of the shield member and at the other end to the cable adjacent to the cable clamp such that the first jaw is positioned within the cover and the cover resists moisture penetration into the clamped cable.

11. A cable clamp according to claim 10, in which the attachment structure comprises an opening in the second jaw arranged to receive an attaching bolt.

12. A cable clamp according to claim 11, in which said fastener comprises a second opening in one of the jaws, a boss in the other of the jaws positioned in the second opening, a threaded opening in the boss, and a bolt threadedly secured in the threaded opening and holding the first and second jaws together.

13. A method for protecting a clamped cable from water intrusion comprising the following steps:

(a) providing a cable clamp comprising first and second jaws configured to clamp a cable in a clamping region, said first jaw having a length less than that of the second jaw, said second jaw comprising an attachment structure adapted to permit attachment of said clamp to an external surface, said cable clamp further comprising a shield member secured in a substantially water-tight manner to the second jaw to protrude outwardly therefrom, said shield member positioned between the attachment structure and the clamping region and comprising a sealing surface, said shield member having a circumference defining a sealing surface positioned radially outwardly with respect to the attachment structure, whereby in use the clamping structure may be provided with a cover sealed to said shield member to inhibit moisture penetration into a clamped cable;

(b) clamping the cable in the clamping structure; and (c) applying a moisture resistant cover to the cable and the cable clamp after step (b) such that the cover seals to the cable on one side of the clamping structure and to the shield member on the other side of the clamping structure.

14. The method of claim 13 wherein step (c) comprises the step of shrinking a tubular cover onto the cable and the cable clamp.

15. The method of claim 13 comprising the further step of:

(d) attaching the attaching structure to an external element after step (c).

* * * * *